United States Patent [19]

Jansse

[11] Patent Number: 4,618,368

[45] Date of Patent: Oct. 21, 1986

[54] METHOD OF INJECTION OF WIRE INTO MOLTEN STEEL AND APPARATUS FOR UNCOILING WIRE FOR USE IN THE METHOD

[75] Inventor: Leonard Jansse, Amsterdam, Netherlands

[73] Assignee: Hoogovens Groep B.V., Ijmulden, Netherlands

[21] Appl. No.: 779,456

[22] Filed: Sep. 24, 1985

[30] Foreign Application Priority Data

Sep. 24, 1984 [NL] Netherlands ..... 8402911

[51] Int. Cl.[4] ..... C21C 7/02

[52] U.S. Cl. ..... 75/53; 75/58; 420/129; 242/128

[58] Field of Search ..... 75/53, 58, 129

[56] References Cited

U.S. PATENT DOCUMENTS

| | | | |
|---|---|---|---|
| 3,125,312 | 3/1964 | McDuffie | 242/129 |
| 3,298,631 | 1/1967 | Richardson, Jr. | 242/129 |
| 4,128,414 | 12/1978 | Hater | 75/53 |
| 4,143,211 | 3/1979 | Obinata | 75/53 |
| 4,154,604 | 5/1979 | Gruner | 75/53 |
| 4,308,056 | 12/1981 | Guarino | 75/53 |

*Primary Examiner*—Peter D. Rosenberg

*Attorney, Agent, or Firm*—Stevens, Davis, Miller & Mosher

[57] ABSTRACT

A method of injection of wire into molten steel wherein a coil of the wire is positioned around a mandrel, and the wire is pulled from the coil in the axial direction of the mandrel and is fed by transport means into the molten steel. To avoid the need to rotate the coil and yet to achieve smooth uncoiling and also to permit tow coils to be uncoiled successively without interruption the coil is a self-supporting parallel-wound coil, which is resiliently clamped around at least part of its outer surface over its whole axial length. The axial length of the mandrel is greater than that of the coil and, at the start of uncoiling of the coil there is a gap of at least 5 cm between the inside surface of the coil and the mandrel. The wire is pulled from the inside of the coil from the inside of the coil through a ring which is mounted around the mandrel axially spaced from the coil and which has a slot-shaped radial extension open to the interior of the ring. The wire end on the outside of the coil is connected to the wire end on the inside of a further such coil through the said slot-shaped radial extension.

7 Claims, 2 Drawing Figures

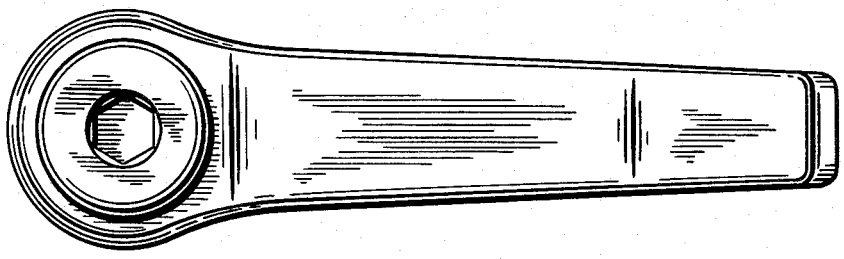
FIG. 6
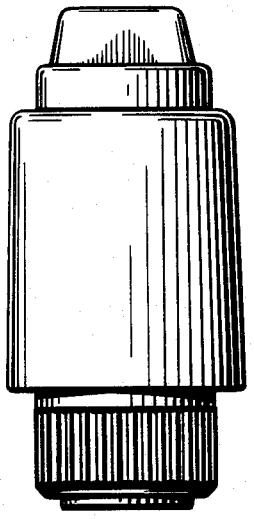
FIG. 5
FIG. 4
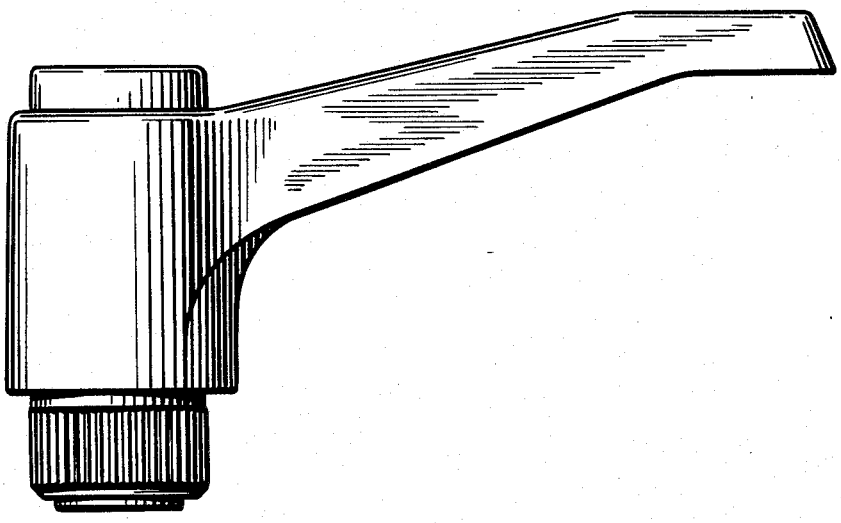

METHOD OF INJECTION OF WIRE INTO MOLTEN STEEL AND APPARATUS FOR UNCOILING WIRE FOR USE IN THE METHOD

BACKGROUND OF THE INVENTION

1. Field of the Invention

The invention relates to a method for the injection of aluminium wire or a similar product into molten steel, in which the wire is pulled from a coil by transport means which transport it to and into the steel bath. The invention also relates to an uncoiling apparatus for the uncoiling of aluminium wire or other wire product to be used in this method.

Although the invention is mainly intended to be applied to the injection of thick aluminium wire into molten steel in order to combine oxygen in the steel and is primarily described below in relation to this use, it is also applicable to the injection of wire of other sizes and of wire of similar sizes but of another composition. For instance, such wires can be used for the alloying of molten steel or for the addition of oxidizing elements. In that case, the wire may be of the hollow powder-filled type.

2. Description of the Prior Art

When combining free oxygen in molten steel, the so-called killing of the steel, it is of importance that an accurate as possible quantity of aluminium is mixed through the steel quickly and homogeneously, without in this process much of the aluminium oxiding prematurely. It is customary to supply aluminium wire of a diameter of 12 mm, at a speed of 8 to 9 m/sec, perpendicularly into the steel bath.

The standard manner in which aluminium wire is supplied is in parallel-wound coils with a weight of approximately 2,000 kg. A parallel-wound coil is one in which the wire windings are wound in layers next to and against each other. Until now, in practice, is has not appeared feasible to unwind the wire from such a coil at the required high speed, in a trouble-free manner and in an exact quantity. When unwinding a rolling coil, the total weight of the coil must first be accelerated and subsequently must be decelerated quickly, which in practice has led to big problems. It has also been suggested (see FIG. 3 of No. DE-B-2 554 860) to pull off such windings overhead, with the coil mounted on a mandrel and the wire passing through a guide above the mandrel, but in doing so it has appeared that the risk is high that several windings fly off the package simultaneously and hence get tangled, or also that several windings spontaneously get loose from the package and fall down and so get tangled.

In practice, therefore, the standard coils of 2,000 kg are recoiled to a bundle of windings, loosely wrapped around a mandrel, which can be pulled off reliably overhead (see FIGS. 1 and 2 of No. DE-B-2 554 680). Here no guide above the bundle is used. This method, however, also has disadvantages, for instance that the body or bundle so formed is very much more voluminous, so that only coils of 400 to 600 kg can be formed. This recoiling requires expensive recoiling installations, and the recoiling operation is time-consuming and requires much labour. Finally, it has appeared that the forming of such loosely wrapped coils leads requires a certain flexibility of the aluminium wire, which sets a top limit on the wire thickness of approximately 12 mm. The need exists for an injection method by which thicker aluminium wire can be injected, as in that case this injecting can be done at a correspondingly lower speed, which, in turn, requires a simpler drive system. Further, the use of thicker wire has the advantage that the risk of oxidation of aluminium at the molten bath is lower.

The invention, therefore, has the primary object to provide a method and an apparatus in which the recoiling of aluminium wire from the standard supplied parallel-wound coils of approximately 2,000 kg is no longer necessary and by which, if desired, thicker aluminium wire can be injected.

No. EP-A-70243 shows a method of uncoiling wire, e.g. for steel treatment, wherein no mandrel is used but the wire is pulled upwardly from the inside of the coil while the exterior of the coil is clamped. The wire is caused to slide on a roller which presses downwardly on the coil at one side to increase its curvature slightly and then passes through an eyelet above the coil. The use of the eyelet prevents the joining of two coils end-to-end.

While it is convenient to pull the wire from the inside of the clamped coil, the present invention has the further object to provide simpler and better control of the wire as it is pulled upwardly and to make possible the joining of two coils end-to-end.

SUMMARY OF THE INVENTION

The invention, in its method aspect, consists in that the wire is pulled from the inside of a coil of the self-supporting parallel-wound type which is placed on a platform preferably with its axial direction substantially vertical and is clamped resiliently around at least part of its outer surface over its entire axial length. The coil is placed around a mandrel which is longer than the axial length of the coil and is of a size such that there is a free gap between the coil and the mandrel at the start of uncoiling of at least 5 cm width, preferably 10 cm. The wire is pulled from within the coil through a ring mounted axially above the coil and around the mandrel, this ring having a slot shaped radial extension open to the interior of the ring, so that the wire end on the outside of the coil is threaded from the coil through this projection and connected with the wire end on the inside of another coil. Instead of being vertical, the coil axis may be horizontal or inclined.

This method can be employed using the uncoiling apparatus according to the invention, which has a platform for the support of the wire coil, a mandrel on the platform around which the coil can be located, a wire guide located axially with respect to the mandrel above the platform and transport means for pulling the wire from the coil on the plaform. According to the invention, the platform is provided with substantially cylindrical enclosure means for enclosing and clamping a self-supporting coil of wire, which enclosure is preferably provided with one or more doors opening outwardly to allow location of the coil on the mandrel and around the mandrel and above the coil a ring is mounted which forms the wire guide and has a face gap between the ring and the mandrel all around the mandrel. The ring has a slot-shaped radial extension open to the interior of the ring. In use of this apparatus the mandrel is longer than the axial length of the coil and has a diameter which is smaller than the inner diameter of the coil.

In comparison with the known method and apparatus, with the new method and apparatus standard coils of 2,000 kg can now be processed instead of recoiled coils of approximately 600 kg. Therefore, each coil can be used for longer and the exchange of coils can be done more easily and with less manpower.

When applying the invention to lengthy casting processes, such as the casting in series of more than one steel ladle in a continuous casting installation, a halt to exchange coils can be omitted, since by the invention coils can easily be joined. This improves the uniformity of the process.

Very much in contrast with previous experiences, is has now appeared that recoiling is no longer necessary, notwithstanding the previous bad experiences with the uncoiling of the parallel-wound coils. This result is only obtainable by the application of the new measures according to the invention, mainly consisting in that the coils are unwound from the inside overhead and that, in doing so, the windings are accurately led between a mandrel and a guide ring. It has further appeared that the outer layers of windings only stay in place during uncoiling if the coil is clamped along the outer surface in the manner described. It is of importance when using coils for the injection of aluminium wire that no residues remain on a coil. For that purpose, it has already been suggested to connect the wire end of each coil with the wire beginning of another coil. This can be done by butt welding of the ends or also by fastening a connecting tube. When using the ring through which the wire is guided, the wire end on the outside of the coil must also be connected through the ring with the beginning of the next coil. In order to prevent that the gyrating unwinding wire hits this connecting piece at each gyration, the invention provides that the ring has the slot-shaped extension or projection in which the connecting wire can lie, without this connecting wire or the extension influencing the movement of the unwinding wire unfavourably.

If the enclosure means for the coil has one or more doors, it is possible to place the coil around a mandrel and to clamp it subsequently by closing the doors. However, in order to carry out the clamping reproducibly with coils of a different diameter, it is preferable, according to the invention, to provide the clamping means with a spring system.

For undisturbed and smooth unwinding of the wire from the coil, it is preferable that certain dimensions are adhered to. In particular the length of the mandrel is preferably at least 1.5 and preferably 2 to 2.5 times the axial coil length, and it preferably has a diameter of 30 to 40 cm. In such a case the ring may have an inner diameter of approximately 55 cm and is preferably mounted at a height of approximately 5 cm above the top of the coil.

It is of importance to design the construction in such a way that the heavy coils of 2,000 kg ca be positioned in a simple way. In the case where the coil is placed around the mandrel from above by a crane, the ring must be made removable. If, on the contrary, the coil is brought into the installation laterally, it is preferable to make the mandrel removable and to remove it temporarily during positioning of the coil. A construction is also conceivable where the ring as well as the mandrel can be removed.

Various constructional embodiments of the principles given herein are conceivable, which however are all considered to fall within the scope of the invention described.

BRIEF INTRODUCTION OF THE DRAWINGS

The preferred embodiment of the invention will now be described by way of non-limitative example with reference to the accompanying drawings, in which:

FIG. 1 is a perspective view from one side of an apparatus embodying the invention, and FIG. 2 shows the ring of the apparatus of FIG. 1.

DESCRIPTION OF THE PREFERRED EMBODIMENT

Figure 1:
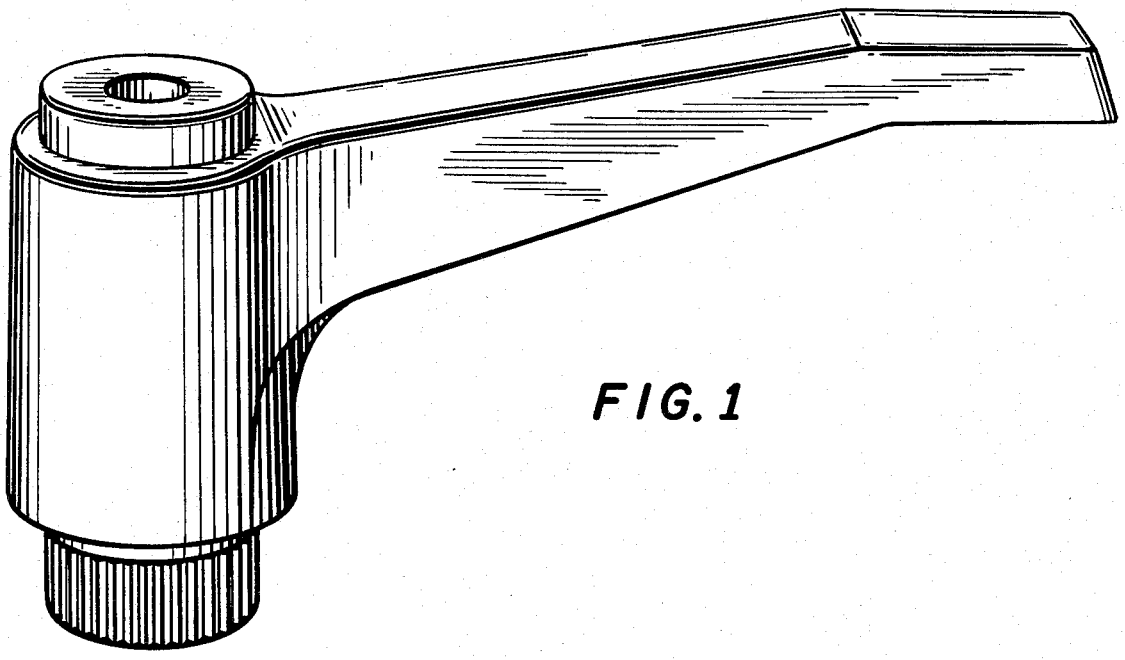

In FIG. 1, there is shown a horizontal platform 1 on which a self-supporting parallel-wound coil 2 indicated by broken lines is placed. The underside of platform 1 has tubular members 3 providing insert holes 3 by means of which it can be moved in the manner of a pallet using a fork lift truck. In the middle of the platform 1 there is mounted a cylindrical mandrel 4 having a cone top and a height of twice the height (axial length) of the coil 2. The coil 2 has an inner diameter D1 and the mandrel has an outer diameter d. At a height h above the upper axial end of the coil 2, there is mounted (in a manner described below) a ring 5 with an inner diameter of D2.

A fencing 9 is mounted on the platform 1 and can be fastened around the coil 2 to form an enclosure therefor. The fencing 9 consists of a quarter-cylindrical part 11 which is fixed to the platform 1 and of two outwardly opening doors 12 and 13 each in the shape of $\frac{3}{8}$ of a cylinder connected by means of vertical hinges 10 to the fixed fencing part 11. By means of spring-mounted bolt connections 14 and 15, doors 12 and 13 can be pulled together against the coil 2 with spring force. Thus the coil is clamped resiliently and held coaxially with the mandrel by the fencing 9, which engages the coil over the full axial height of the coil.

The ring 5 is carried by four legs 6 of which two are longer and two are shorter. The ends of the two longer legs 6 are removably slid into bushings 7 on the platform and secured therein by transverse bolts 8 in a manner such the the ring is slightly adjustable in its vertical position. The two shorter legs 6 are similarly removably held in the bushings (not shown) fastened to the fixed part 11 of the fencing near the hinges 10.

The mandrel 4 may be mounted removably on the platform 1 by fastening means (not drawn), in which case the coil 2 can be placed on the platform by moving it in the horizontal direction, having opened the doors 12,13 as shown by broken lines. In that case, it is possible to fix the ring to the fencing 11. In the construction illustrated, however, the mandrel 4 is permanently fixed to the platform 1, and the ring 5 with the legs 6 must first be removed from the bushings 7 before the coil 2 can be lowered vertically over the mandrel onto the platform.

Figure 2:
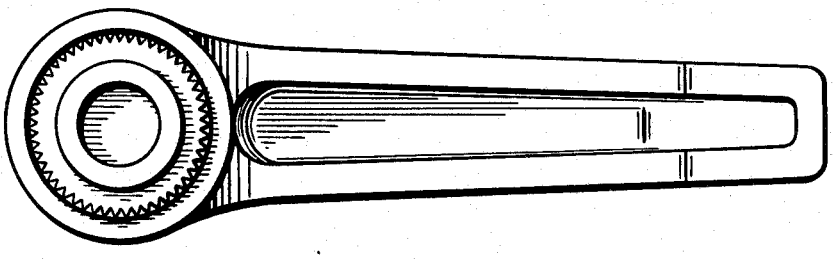
Figure 3:
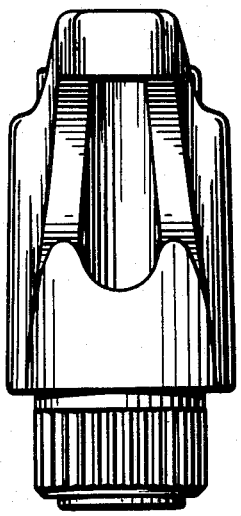

FIG. 2 show the ring 5 with the legs 6 attached thereto. It can be seen here that one of the legs 6 divides to form a slot-shaped radial extension of the ring 5. The slot of the ring so formed is used to accommodate the outer free end of coil 2 which can be threaded in an upward direction through it in order to be connected with another coil. In this way two coils can be joined so as to be pulled off one after the other without interruption.

In a practical example, good results were obtained with the following choice of dimensions:

D1=53 cm

D2=55 cm d=35 cm
h=5 cm.

The transport means for pulling the wire generally axially upwardly from the inside of the coil 2 and feeding it in a metered manner into the steel bath are not shown. Such transport means are well-known (see for example No. DE-B-2 554 860) and need not be described.

In use of the illustrated apparatus in the method according to the invention, a self-supporting parallel wound coil 2 is placed around the mandrel 4 and resiliently clamped in position by the fencing 11,12,13. In this position there is a free gap of 9 cm between the mandrel and the inside face of the coil all around the mandrel. The end of the wire at the inside of the coil is passed through the ring 5 into the transport means while the end at the outside of the coil is passed through the ring 5 to be joined to the inside end of a further coil mounted on similar apparatus. This outside end is located in the slot 16 while the wire is being pulled from the coil 2, so that it does not interfere with the wire being pulled.

What is claimed is:

1. A method for injecting wire into molten steel comprising (a) positioning a self-supporting parallel-wound coil of the wire around a mandrel, resiliently clamping the coil around at least part of its outer surface over its whole axial length, the axial length of the mandrel being greater than that of the coil and, at the start of uncoiling of the coil there being a gap of at least 5 cm between the inside surface of the coil and the mandrel, (b) thereafter pulling the wire from the inside of the coil and feeding the wire into the molten steel through a ring which is mounted around the mandrel axially spaced from the coil and which has a slot-shaped radial extension open to the interior of the ring, and (c) connecting the wire end on the outside of the coil to the wire end on the inside of a further such coil through the said slot-shaped radial extension.

2. The method according to claim 1 including placing the coil for uncoiling on a platform so that its axis is substantially vertical.

3. Apparatus for uncoiling wire, comprising platform for carrying a self-supporting coil of wire, a mandrel on the platform around which the coil can be located, a wire guide located axially with respect to the mandrel above the platform, wire transport means for pulling the wire from the coil on the platform having substantially cylindrical enclosure means for enclosing and clamping a coil of wire when said coil is mounted around the mandrel, and a ring mounted around the mandrel at a distance from the platform with a free gap between the ring and the mandrel all around the mandrel, the ring having a slot-shaped radial extension open to the interior of the ring.

4. Apparatus according to claim 3 wherein the enclosure means has at least one outwardly openable door to allow positioning of the coil on the platform.

5. Apparatus according to claim 3 wherein the enclosure means is adapted to clamp the coil resiliently.

6. Apparatus according to claim 3 wherein the mandrel has a diameter of 30 to 40 cm and the ring has an inner diameter of about 55 cm.

7. Apparatus according to claim 3 wherein at least one of the ring and the mandrel is removable from the platform.

* * * * *

UNITED STATES PATENT AND TRADEMARK OFFICE

CERTIFICATE OF CORRECTION

PATENT NO. : 4,618,368

DATED : October 21, 1986

INVENTOR(S) : Leonard Jansse

It is certified that error appears in the above-identified patent and that said Letters Patent is hereby corrected as shown below:

On the Title Page Item [73], "Ijmulden" should read -- IJmuiden --.

The Title Page should be deleted to appear as per attached Title Page.

Figures 1 - 6 of the drawing should be deleted to appear as per attached Figures 1 and 2.

United States Patent [19]

Jansse

[11] Patent Number: 4,618,368

[45] Date of Patent: Oct. 21, 1986

[54] METHOD OF INJECTION OF WIRE INTO MOLTEN STEEL AND APPARATUS FOR UNCOILING WIRE FOR USE IN THE METHOD

[75] Inventor: Leonard Jansse, Amsterdam, Netherlands

[73] Assignee: Hoogovens Groep B.V., Ijmulden, Netherlands

[21] Appl. No.: 779,456

[22] Filed: Sep. 24, 1985

[30] Foreign Application Priority Data

Sep. 24, 1984 [NL] Netherlands ..... 8402911

[51] Int. Cl.[4] ..... C21C 7/02

[52] U.S. Cl. ..... 75/53; 75/58; 420/129; 242/128

[58] Field of Search ..... 75/53, 58, 129

[56] References Cited

U.S. PATENT DOCUMENTS

| | | | |
|---|---|---|---|
| 3,125,312 | 3/1964 | McDuffie | 242/129 |
| 3,298,631 | 1/1967 | Richardson, Jr. | 242/129 |
| 4,128,414 | 12/1978 | Hater | 75/53 |
| 4,143,211 | 3/1979 | Obinata | 75/53 |
| 4,154,604 | 5/1979 | Gruner | 75/53 |
| 4,308,056 | 12/1981 | Guarino | 75/53 |

*Primary Examiner*—Peter D. Rosenberg
*Attorney, Agent, or Firm*—Stevens, Davis, Miller & Mosher

[57] ABSTRACT

A method of injection of wire into molten steel wherein a coil of the wire is positioned around a mandrel, and the wire is pulled from the coil in the axial direction of the mandrel and is fed by transport means into the molten steel. To avoid the need to rotate the coil and yet to achieve smooth uncoiling and also to permit tow coils to be uncoiled successively without interruption the coil is a self-supporting parallel-wound coil, which is resiliently clamped around at least part of its outer surface over its whole axial length. The axial length of the mandrel is greater than that of the coil and, at the start of uncoiling of the coil there is a gap of at least 5 cm between the inside surface of the coil and the mandrel. The wire is pulled from the inside of the coil from the inside of the coil through a ring which is mounted around the mandrel axially spaced from the coil and which has a slot-shaped radial extension open to the interior of the ring. The wire end on the outside of the coil is connected to the wire end on the inside of a further such coil through the said slot-shaped radial extension.

7 Claims, 2 Drawing Figures

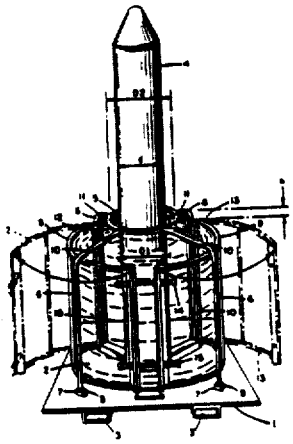

UNITED STATES PATENT AND TRADEMARK OFFICE

CERTIFICATE OF CORRECTION

PATENT NO. : 4,618,368

DATED : October 21, 1986

INVENTOR(S) : Leonard Jansse

It is certified that error appears in the above-identified patent and that said Letters Patent is hereby corrected as shown below:

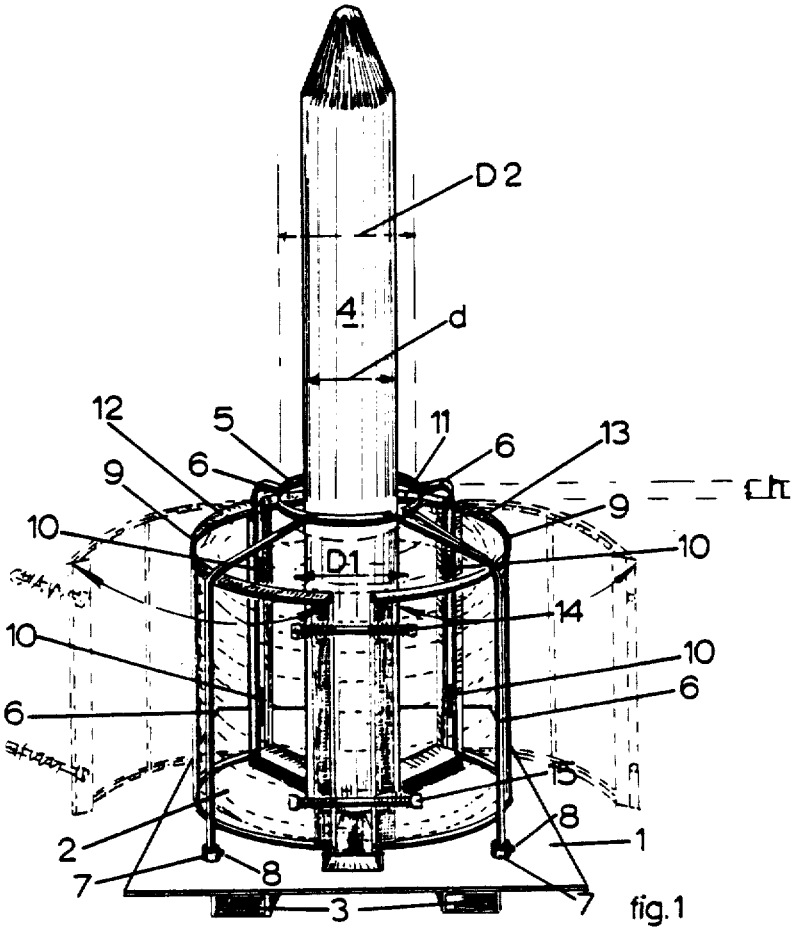

fig.1

UNITED STATES PATENT AND TRADEMARK OFFICE

CERTIFICATE OF CORRECTION

PATENT NO. : 4,618,368 Page 4 of 4

DATED : October 21, 1986

INVENTOR(S) : Leonard Jansse

It is certified that error appears in the above-identified patent and that said Letters Patent is hereby corrected as shown below:

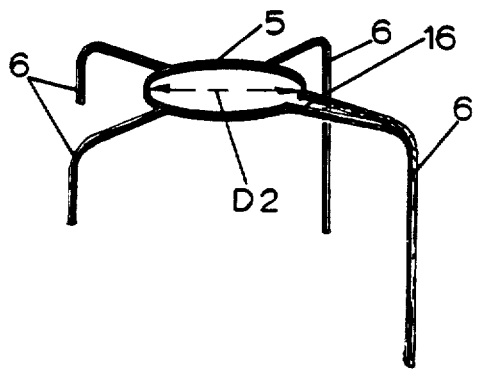

fig. 2

Signed and Sealed this

Thirteenth Day of October, 1987

*Attest:*

DONALD J. QUIGG

*Attesting Officer*

*Commissioner of Patents and Trademarks*